United States Patent [19]

Cribben

[11] Patent Number: 4,468,905

[45] Date of Patent: Sep. 4, 1984

[54] INSULATED GLASS SPACER

[75] Inventor: James T. Cribben, Mechanicsburg, Pa.

[73] Assignee: Capitol Products Corporation, Mechanicsburg, Pa.

[21] Appl. No.: 381,249

[22] Filed: May 24, 1982

[51] Int. Cl.[3] ..... E06B 3/24; E04B 1/90

[52] U.S. Cl. ..... 52/172; 52/308; 52/789

[58] Field of Search ..... 52/172, 304, 789, 308; 160/395

[56] References Cited

U.S. PATENT DOCUMENTS 2,915,793 12/1959 Berg ..... 52/789

3,321,885 5/1967 Pratt ..... 160/395

4,335,166 6/1982 Lizardo et al. ..... 52/789

FOREIGN PATENT DOCUMENTS 2538489 3/1977 Fed. Rep. of Germany ..... 52/172

*Primary Examiner*—James L. Ridgill, Jr.

*Attorney, Agent, or Firm*—Donald L. Johnson; John F. Sieberth; Paul H. Leonard

[57] ABSTRACT

The present invention relates to a combination glass spacer and plastic film holder for installation in an insulated glass panel. A channel or opening for receiving an edge of a thin plastic sheet or film is integrally formed at the upper or topside of a somewhat rectangular shaped longitudinal tubular member.

5 Claims, 3 Drawing Figures

INSULATED GLASS SPACER

BACKGROUND OF THE INVENTION

This invention is in the general field of construction and relates to windows and doors. The invention especially relates to a glass spacer for insulated, dual pane windows or multi-glazed windows.

The present invention particularly provides an improved insulated glass spacer which is adapted to be used with plastic film positioned between two panes of glass in an insulated glass.

It is generally recognized that doors and windows on exterior walls allow major heat losses far in excess of their relative cross-sectional areas. A variety of solutions have been proposed or used to reduce this heat loss, including storm windows, plastic film over the glass panels, interior and exterior shades over the windows, and insulated glass or multi-pane windows. The latter are often preferred, but are more difficult to manufacture, relatively expensive and generally suitable only for new construction.

In manufacturing an insulated glass window, it is necessary that each pane of glass in the window be separated from the other by some type of spacer. These spacers are generally longitudinal plastic or extruded metal, rectangular or other desired shape, tubular members. A spacer which has found some degree of commercial success is a roll formed tubular aluminum member, rectangular in cross-section.

With soaring utility costs, a need exists for more thermally efficient window assemblies. More recently triple glazed windows have been grown in popularity.

In a triple glazed window, three panes of glass are separated by two spacers. Such construction is considerably expensive.

Various means have been proposed to reduce the cost of triple glazing or tripled-pane insulated glass. One type of window assembly utilizes a thin polyester transparent film, sometimes referred to as a "heat mirror" which is positioned or permanently installed between two panes of glass. The film is mounted or glazed in a plastic frame which is then glued or otherwise anchored to a regular or modified insulated glass spacer positioned between two panes of glass. In this case, the two glass panes are spaced apart a greater distance than they would be in normal double-paned or dual glazed insulated glass. The transparent film takes the place of a center glass panel and provides an effective "triple-glazed" window. For example, the U-value for a conventional double glazed window is 0.50 and about 0.31 for a triple glazed window. A double glazed window with a thin transparent polyester film dividing the air space has a U-value of about 0.22. Since such a window is transparent, it has a considerably improved appearance over solar control films which give windows a metallic or mirror like appearance.

It can readily be appreciated that the plastic film must be mounted between the glass panels in a taut position. It can also be appreciated that the means on which the film is mounted should reduce the visible window area as little as possible, and should be more or less invisible when viewed from within or without.

One means for attaching a plastic film to a frame and to hold it in a taut position is illustrated by U.S. Pat. No. 4,189,880 issued to Bollin on Feb. 26, 1980.

The patentee has provided a channel member for receiving an edge of a film sheet. The channel member has a central projection for receiving a groove on a T-shaped spline which is so constructed as to tightly fit in the channel member. The film is then stretched tautly and another edge locked in place, such sheet-engaging members are not particularly suited for holding a thin plastic sheet between two panes of glass.

More recently, U.S. Pat. No. 4,182,088 issued to Ball on Jan. 8, 1980 utilizes a clip-type channel member for receiving sheet material and using a rod to lock the sheet material in place in the channel opening. In cross-section, the channel member is shaped like a shepherd's crook.

SUMMARY OF THE INVENTION

The present invention relates to a combination insulated glass spacer and film holder for placing between two glass panels of a window and for receiving an edge of a sheet of plastic film so that the film can be held tautly in position substantially in the center of the area between the two glass panes. The combination spacer is a somewhat rectangularly shaped tubular member which has a horizontal channel or pocket at the top thereof for receiving a plastic sheet and for receiving a spline therein thereby locking the plastic sheet in the spacer.

It is a primary object of the present invention to provide an improved means for installing a sheet of thin plastic film as a center lite between two panes of glass in an insulated glass panel.

Another object of the invention is to provide a combination glass spacer and film holder for an insulated glass system using a thin plastic film as the center lite of a triple glazed "sandwich" assembly.

Still another object of the invention is to provide a combination glass spacer and film holder for insulated glass panels which can be easily manufactured and installed and which is relatively inexpensive.

Other objects and advantages of the instant invention will become more readily apparent from a consideration of the following description and drawings hereinafter.

BRIEF DESCRIPTION OF THE DRAWINGS

In the drawings, like characters of reference designate like parts throughout the several views.

DESCRIPTION OF THE PREFERRED EMBODIMENTS

Figure 1:
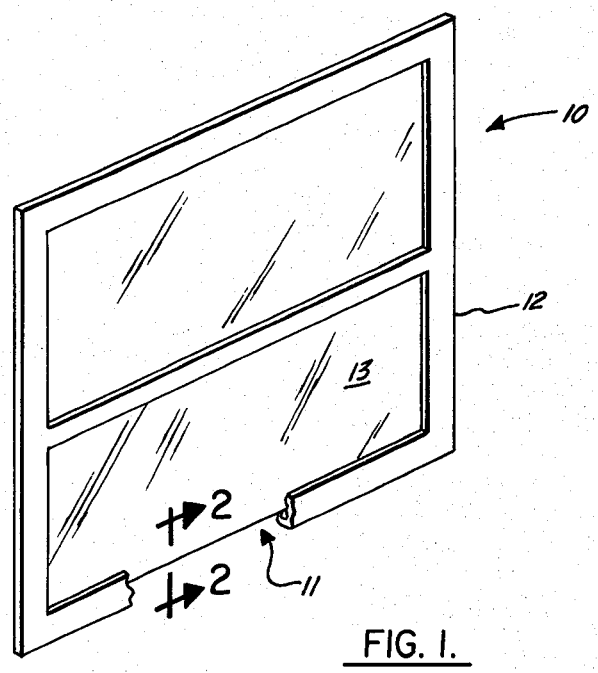
FIG. 1 is a perspective view of an insulated glass window sash with a portion of the bottom rail removed therefrom.

FIG. 1 illustrates a common type insulated glass sash 10. The sash 10 comprises an insulated glass panel 1 which is installed in a customary manner in a frame 12. The latter may be constructed of metal, wood or even plastic or combination of such. Aluminum alloys and steel are the most common metals used for windows.

The panel 11 comprises glass panes 13 and 14 (see FIG. 2) which are spaced apart by a longitudinal somewhat rectangularly shaped tubular spacer 20, a transparent thin plastic film 15, a spline 16 for holding or locking the film 15 in the spacer 20, and a seal 17 for holding the spacer in position and for sealing off the space between the two glass panes. The film 15 is tautly held in position by the spacer 20 so as to be substantially in the center of the space between the panes 13 and 14. The distances a-b and c-d are substantially equal. A dessicant such as silica gel is included in the space 18 in the spacer 20.

Figure 3:
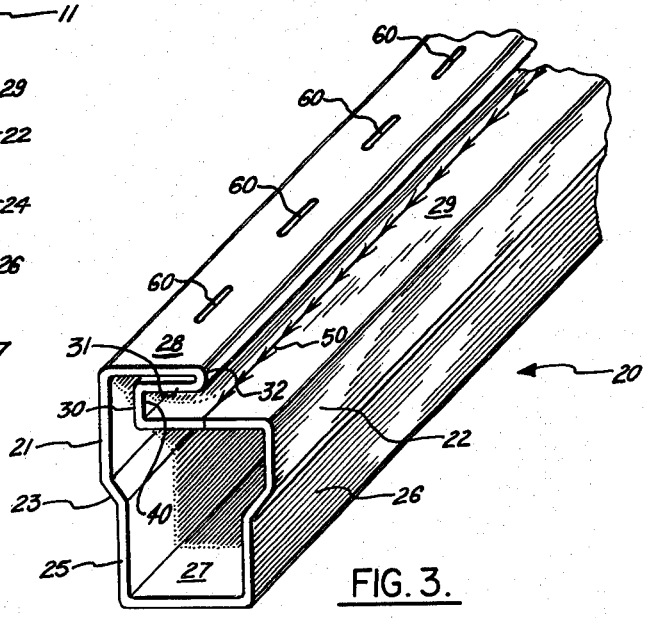

As best seen in FIG. 3, the spacer 20 is a one-piece roll formed aluminum tubular member which is somewhat rectangularly shaped when viewed in cross-section. The spacer 20 has spaced apart parallel sides 21 and 22. Side 21 is somewhat longer than side 22. Sides 21 and 22 are bent inwardly to 23 and 24, respectively, to form spaced apart parallel and substantially equal sides 25 and 26. Sides 25 and 26 are joined together by horizontal side 27. Sides 25, 27 and 24 in effect form a substantially U-shaped channel member.

Extending inwardly at a right angle from side 21 is a short upper side 28 which is of a length such that it extends to a line extending vertically from the center or mid-joint of side 27.

Extending inwardly from short side 22 is a long upper side 29. A short side 30 extends vertically from side 29 and a short side 31 extends horizontally and parallel to side 28 so as to be joined thereto at 32. Sides 31 and 30 along with a portion of side 29 form a channel 40. A standard seam 50 is shown where the members forming the side 29 are joined together. The location of the seam is unimportant and could be at any convenient place. Should the spacer 20 be an extruded or molded member there would be no seam.

Conveniently located across the top of the side 28 are a plurality of spaced apart small holes or openings 60. Such openings allow moisture in the dead space between the glass panes to be absorbed by the dessicant positioned in the spacer 20. Although the holes are illustrated as longitudinal slits, they may be round, oval or any other suitable shape. The openings, of course, may be located in any other part of the spacer exposed to the dead-air area between two glass panes separated by the spacer.

Figure 2:
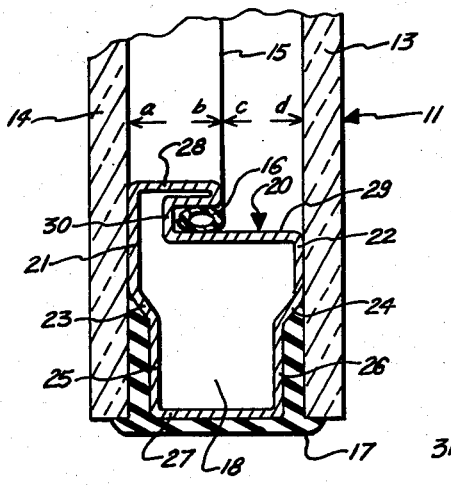
FIG. 2 is a view taken along line 2—2 of FIG. 1 illustrating a cross-section of the insulated glass spacer of this invention after installation; and, FIG. 3 is an enlarged perspective view of a longitudinal section of the insulated glass spacer of this invention.

It can be appreciated that the view shown in FIG. 2 is somewhat enlarged and that although the spacer 20 and channel 40 therein seem somewhat large, in actuality they are somewhat small and would not be readily observable to the naked eye.

The present invention provides a relatively simple and economical means and method for constructing a triple glazed window. Such a window is not only cheaper than a normally constructed triple glazed window, i.e. one having three distinct panes of glass in a panel, but one which is even more thermally efficient.

Although a transparent polyester film is preferred, any other suitable plastic film may be used. The film should be transparent unless the window is to be translucent. The film should also be relatively thin, but sufficiently strong that it can be stretched tautly. It should also be of such material that it is long lasting and not subject to deterioration from sunlight, heat, cold, or other environmental conditions to which it will be subjected to.

Some variation may be made in the specific configuration of the spacer. The spacer should be of such cross-sectional shape though that it will space apart the glass pane and the plastic film from each other a desired or necessary distance. The channel for receiving the film should also have a substantially horizontal opening, i.e. one in which an edge of the plastic film is inserted at approximately right angles to its normally vertical position. Once the film is inserted in the receiving channels, pulled tightly and all splines inserted to lock the film in position, the film should remain in position substantially the life of the insulated glass panel.

It can be appreciated that insulated glass panels may be installed in almost an infinite variety of types and shapes of window frames. The sash frames, i.e. rails, stiles, etc., may be constructed of wood, plastic, or metal. Aluminum and steel are the preferred metals, with aluminum extrusions being especially preferred.

Various types or grades of glass may also be used as desired. The glass or "light" areas are preferably clear or transparent, but they may also be translucent. Opaque glass could also be used, but if opaqueness is desired, other means than windows are normally desired.

The shape of the spacer as well as the materials used may also be varied. The shape in cross-section should be such that a pair of glass panes may be separated thereby a desired or predetermined distance. The space should also have a bottom area for retaining or holding a dessicant. The spacer preferably has a plurality of openings therein which are in fluid contact with a dead-air space located between the two panes of glass being separated by the spacer. The spacer should be of such a shape that when installed, at least some joints on each side member or each side adjacent a glass pane is in direct contact with such pane, so that no movement of the glass panes can occur. The spacer should also be of such shape that adequate or suitable insulation may be positioned therearound so that when the spacer is installed and sealed, that a dead-air space is formed in the area between each pane of glass and exterior of the spacers. The sealant is extended around the periphery of the glass panes. A silicone sealant material is especially useful. Any other type of sealant may be used without departing from the scope of the invention.

The foregoing disclosure and description of the invention is illustrative and explanatory thereof and various changes in the illustrated process may be made within the scope of the appended claims without departing from the spirit of the invention.

What is claimed:

1. A combination glass spacer and plastic film holder for installation between two panes of glass in an insulated glass panel, comprising a unitary somewhat rectangularly shaped longitudinal member having two outermost sides which are substantially parallel to each other, each of said two outermost sides being bent inwardly a relatively short distance and each respectively forming a pair of spaced apart equal sides which are substantially parallel to each other but spaced nearer to each other than the two outermost sides are spaced to each other, said two equal sides being joined together by a flat side to thereby form a channel or U-shaped member, one of said outermost sides being taller than the other outermost side and said outermost sides being joined together by a single relatively small horizontal channel positioned therebetween and integrally formed therewith, said horizontal channel being adapted to receive a thin plastic sheet or film and so formed that it may receive one edge of the plastic film at approximately a right angle to the normal position of the plastic film when installed in said spacer.

2. The spacer of claim 1, in combination with a spline adapted to fit in said channel after the film or sheet has been inserted therein and to lock or hold said sheet in said channel.

3. The spacer of claim 1, wherein said spacer is of roll formed aluminum.

4. The spacer of claim 1, wherein a plurality of spaced apart openings are located in a top side of the spacer.

5. The combination glass spacer and plastic film holder of claim 1, wherein said horizontally positioned channel formed on said spacer is so located thereon that when said spacer is positioned between the panes of glass and the plastic film is installed in said channel and extended paralleledly between the panes of glass, the plastic film is substantially equi-distant from each of said two outermost sides.

* * * * *